United States Patent [19]

Atwood et al.

[11] Patent Number: 4,475,771

[45] Date of Patent: Oct. 9, 1984

[54] CYCLIC SOLUTION MINING OF BORATE ORES

[75] Inventors: George E. Atwood; Douglas E. Cochran, both of Tucson, Ariz.; Abraham Sadan, Salt Lake City, Utah; Charles Burnett, Barstow, Calif.; Phillip O. Tyree; Archibald W. Fletcher, both of Tucson, Ariz.

[73] Assignee: Duval Corporation, Tucson, Ariz.

[21] Appl. No.: 479,239

[22] Filed: Mar. 28, 1983

[51] Int. Cl.[3] ..... E21C 41/14

[52] U.S. Cl. ..... 299/4; 299/7; 299/5

[58] Field of Search ..... 299/4, 7, 5

[56] References Cited

U.S. PATENT DOCUMENTS

| | | | |
|---|---|---|---|
| 556,669 | 3/1896 | Frasch . | |
| 1,308,577 | 7/1919 | Calvert et al. . | |
| 1,891,667 | 12/1932 | Carr . | |
| 1,927,013 | 9/1933 | Cramer et al. | 423/283 |
| 1,944,598 | 1/1934 | Franke . | |
| 1,969,230 | 8/1934 | McMillen . | |
| 2,356,205 | 8/1944 | Blair et al. . | |
| 2,855,276 | 10/1958 | May | 423/283 |
| 3,103,412 | 9/1963 | Dwyer . | |
| 3,218,120 | 11/1965 | Amodeo . | |
| 3,353,603 | 11/1967 | Knight . | |
| 3,574,599 | 4/1971 | Ortloff et al. . | |
| 3,708,014 | 1/1973 | Wally | 166/307 |
| 3,829,553 | 8/1974 | Lynn | 423/279 |
| 3,917,801 | 11/1975 | Wilson | 423/283 |
| 3,953,580 | 4/1976 | Allen et al. | 423/328 |
| 3,966,541 | 6/1976 | Sadan | 159/47 R |
| 4,022,871 | 5/1977 | Denille | 423/283 |
| 4,072,472 | 2/1978 | Lukes . | |
| 4,103,963 | 8/1978 | Espenscheid et al. | 299/4 |
| 4,270,944 | 6/1981 | Eastes et al. | 65/27 |
| 4,358,157 | 11/1982 | Showalter | 299/4 |

FOREIGN PATENT DOCUMENTS

| | | |
|---|---|---|
| 2020570 | 11/1970 | Fed. Rep. of Germany . |
| 2608597 | 9/1976 | Fed. Rep. of Germany . |
| 45-2650 | of 1970 | Japan . |
| 52241 | 7/1970 | Romania . |
| 158922 | 2/1921 | United Kingdom . |
| 1297743 | 11/1972 | United Kingdom . |
| 1379098 | 1/1975 | United Kingdom . |

OTHER PUBLICATIONS

Yan, J. Pet. Tech. 32 (1980) 2068.

*Primary Examiner*—Stephen J. Novosad
*Assistant Examiner*—Mark J. DelSignore
*Attorney, Agent, or Firm*—Millen & White

[57] ABSTRACT

A method of recovering boric acid from a subterranean deposit of colemanite ore by solution mining, comprises:

supplying a leach solution comprising hydrochloric acid to the subterranean deposit via an injection well in communication therewith, whereby colemanite ore is dissolved and an aqueous pregnant solution of boric acid and calcium chloride is formed in the deposit;

withdrawing the pregnant solution of boric acid and calcium chloride from said deposit via a production well in communication therewith;

separating boric acid from the withdrawn solution;

adding sulfuric acid to the resultant concentrated solution from which boric acid has been separated, whereby hydrochloric acid is regenerated therein and $CaSO_4.2H_2O$ is formed;

separating $CaSO_4.2H_2O$ from the resultant solution containing regenerated hydrochloric acid thereby forming a regenerated leach solution; and recycling the regenerated leach solution to the subterranean deposit of colemanite via an injection well.

22 Claims, 7 Drawing Figures

CYCLIC SOLUTION MINING OF BORATE ORES

BACKGROUND OF THE INVENTION

The present application relates to a new efficient, economical, nonpolluting cyclic process for producing boric acid by in situ solution mining of a subterranean deposit containing a borate ore which preferably is flooded or located below the water table.

The conventional method of producing boric acid is to react already mined borate-containing ore with sulfuric acid. In the United States of America the mined ore generally contains high concentrations of the mineral kernite, a sodium borate: $Na_2B_4O_7.4H_20$. The reaction with sulfuric acid proceeds according to the following equation:

$$Na_2O.2B_2O_3.4H_2O+H_2SO_4+H_2O \quad Na_2SO_4+4H_3BO_3$$

The boric acid is separated from the more readily soluble sodium sulfate by selective crystallization. See, e.g., U.S. Pat. Nos. 3,917,801; 3,953,580; Japanese No. 7,002,650; U.S. Pat. Nos. 4,270,944; 1,944,598, 3,103,412; and 2,855,276.

In Europe, however, the generally available mineral is colemanite, $Ca_2B_6O_{11}.5H_2O$, e.g., imported from Turkey. In this case, the reaction with acid proceeds according to the equation:

$$Ca_2B_6O_{11}.5H_2O+2H_2SO_4+6H_2O \quad 6H_3BO_3+2CaSO_4.2H_2O$$

The mineral is first crushed ad ground to a fine particle size and then leached with sulfuric acid in agitated reactors at elevated temperatures. Separation is relatively easy since the boric acid goes into solution and is separated from the sparingly soluble gypsum and other insoluble components of the ore by filtration. Boric acid is then recovered from the filtrate by crystallization.

Boric acid may also be produced by alkaline leaching of borate ores. This practice is well known and is described e.g., in: German No. 2,020,570; U.S. Pat. No. 3,829,553; German No. 2,608,597; G.B. Nos. 158,992; 1,379,098; U.S. Pat. Nos. 3,218,120; 4,022,871; G.B. No. 1,297,743; and Romanian No. 52,241.

In the past, hydrochloric acid has also been used to solubilize mined borate ores. U.S. Pat. No. 1,308,577 uses HCl to produce boric acid from a borate salt (borax), and U.S. Pat. No. 2,855,276 digests already mined crude colemanite ore using hydrochloric acid. Advantageous use of the classic salting-out effect is also discussed in this reference, and in others in conjunction with the mining of other borate ores, e.g., in U.S. Pat. No. 1,927,013.

Other lixiviants are also known in the mining of borate ores such as colemanite, e.g., ammonium sulfate as taught in U.S. Pat. No. 3,103,412 wherein the lixiviant is regenerated and recycled.

However, all of these conventional techniques have serious disadvantages. For example, all require the movement of large tonnages of ore and waste rock and all require crushing and grading of the ore. In addition, these conventional techniques tend to be capital cost intensive with respect to plant and equipment.

In situ solution mining methods which eliminate some of these disadvantages have been applied to the mining of other types of elements. For example, this method has proved to be very effective for the recovery of uranium from sandstone and other deposits which have the requisite degree of permeability. The latter property of the deposit is critical in controlling the rate of recovery of mineral values by solution mining techniques. The problem is especially severe when the leaching reaction produces insoluble byproducts stemming from either the main ore or other components of the deposit. Because of these problems, the applicability of solution mining to other types of ores has been limited. See, e.g., U.S. Pat. No. 4,103,963; USBM - IC 8777, 1978 ("Uranium In Situ Leach Mining in the United States"); Yan, J. Pet. Tech. 32(1980) 2068; and U.S. Pat. No. 3,574,599, for general discussions of the application of the solution mining technique to ores, usually uranium ores, and, for a discussion of the importance of maintaining high permeability, i.e., avoiding deposit blockage, usually by addition of a chemical inhibitor.

The same difficulty of blockage has also been encountered in other types of mining operations, e.g., in petroleum mining. Various methods of avoiding such blockages have been developed, including the addition of HCl to subterranean wells to dissolve deposits as disclosed, e.g., in U.S. Pat. Nos. 2,356,205; 3,353,603; 3,708,014; 1,891,667; 1,969,230; and 556,669.

In conjunction with solution mining, solar evaporation ponds have sometimes been employed to recover the desired salt from the produced brine (U.S. Pat. Nos. 4,072,472 and 3,966,541).

SUMMARY OF THE INVENTION

Accordingly, it is an object of this invention to provide a new method for mining borate ores which avoids the disadvantages of the prior art.

It is another object of this invention to provide such a method which is efficient, economical, nonpolluting and cyclic.

It is yet another object of this invention to provide such a method which involves expenditure only of relatively cheap and accessible lixiviants.

It is a further object of this invention to provide such a method which involves in situ mining of the borate ore, especially of colemanite ores and most especially those associated with a relatively low content of other acid consuming minerals.

Upon further study of the specification and appended claims, further objects and advantages of this invention will become apparent to those skilled in the art.

These objects have been obtained by providing a method of recovering boric acid from a subterranean deposit of colemanite ore, comprising:

supplying a leach solution comprising hydrochloric acid to the subterranean deposit via an injection well in communication therewith, whereby colemanite ore is dissolved and an aqueous pregnant solution of boric acid and calcium chloride is formed in the deposit;

withdrawing the pregnant solution of boric acid and calcium chloride from said deposit via a production well;

separating boric acid from the withdrawn solution;

adding sulfuric acid to the resultant concentrated solution from which boric acid has been separated, whereby hydrochloric acid is regenerated therein and $CaSO_4.2H_2O$ is formed;

separating $CaSO_4.2H_2O$ from the resultant solution containing regenerated hydrochloric acid thereby forming a regenerated leach solution; and recycling the regenerated leach solution to the subterranean deposit of colemanite via an injection well.

In various preferred aspects of this invention, the separation of the boric acid from its mother liquor is accomplished by solar evaporation of water to crystallize boric acid; the recycled regenerated hydrochloric acid lixiviant can be heated prior to injection into the subterranean deposit, whereby the process is rendered more efficient and the production rate significantly increased; subsequent to production, additional already recovered crude boric acid is dissolved into the pregnant solution after the latter is further heated; and/or the pregnant liquor is flash cooled and/or various other features which are discussed below are employed.

BRIEF DESCRIPTION OF THE DRAWINGS

Various other objects, features and attendant advantages of the present invention will be more fully appreciated as the same becomes better understood when considered in conjunction with the accompanying drawings, and wherein.

DETAILED DISCUSSION

In its most preferred aspect, the method of this invention is used in conjunction with a subterranean deposit containing the mineral colemanite, ($Ca_2B_6O_{11}.5H_2O$). However, in general, it is applicable to other calcium-borate ores which are solubilizable using hydrochloric acid. Such minerals include the following in addition to colemanite:

Meyerhofferite
Priceite
Inyoite
Ulexite
Probertite
Howlite

It is especially applicable to ores in which the gangue is not acid consuming, or which upon solubilization by hydrochloric acid, produce products from which hydrochloric acid can be subsequently regenerated. In cases where the ore contains sodium borates in addition to calcium borates, alternative conventional methods will be used for removing sodium sulfate from the liquor recycled to the in situ leaching step. This is because, unlike calcium sulfate, sodium sulfate is highly soluble.

The details of the leach solution for any given application can be determined by conventional considerations in conjunction with conventionally obtained knowledge of the properties of the deposit and the overall process conditions which are utilized. For example, the concentration of hydrochloric acid in the lixiviant will be determined primarily by the amount required to react with colemanite and solubilize the boric acid produced to the limit of its solubility in the leach solution, temperature being a primary variable in this regard. The amounts of various other components which are recycled, e.g., $H_3BO_3$, $CaCl_2$, NaCl, $H_2SO_4$, etc., will depend upon the optimized conditions utilized in the other stages of the process, e.g., the amount of recycled boric acid will depend upon the optimized recoverability of boric acid from the boric acid recovery states. In general, the amount of hydrochloric acid in the leach solution will be in the range of 1–10 wt. %, values outside of this range, of course, being possible under appropriate circumstances. Typically, the resultant pregnant solution will have a content of boric acid of 2–14 wt. %, i.e., it will be essentially saturated or from 75–100% of the saturation value in commercial production.

It is also possible for the leach solution to contain conventional auxiliaries which are generally dependent upon the precise procedures used in the various stages.

As discussed further in detail below with respect to various preferred aspects of this invention, the temperature of the leach solution is a relatively important variable; generally, higher temperatures yield a more efficient process with attendant higher production rates. In general, suitable temperatures are in the range of 20°–70° C.

Figure 1:
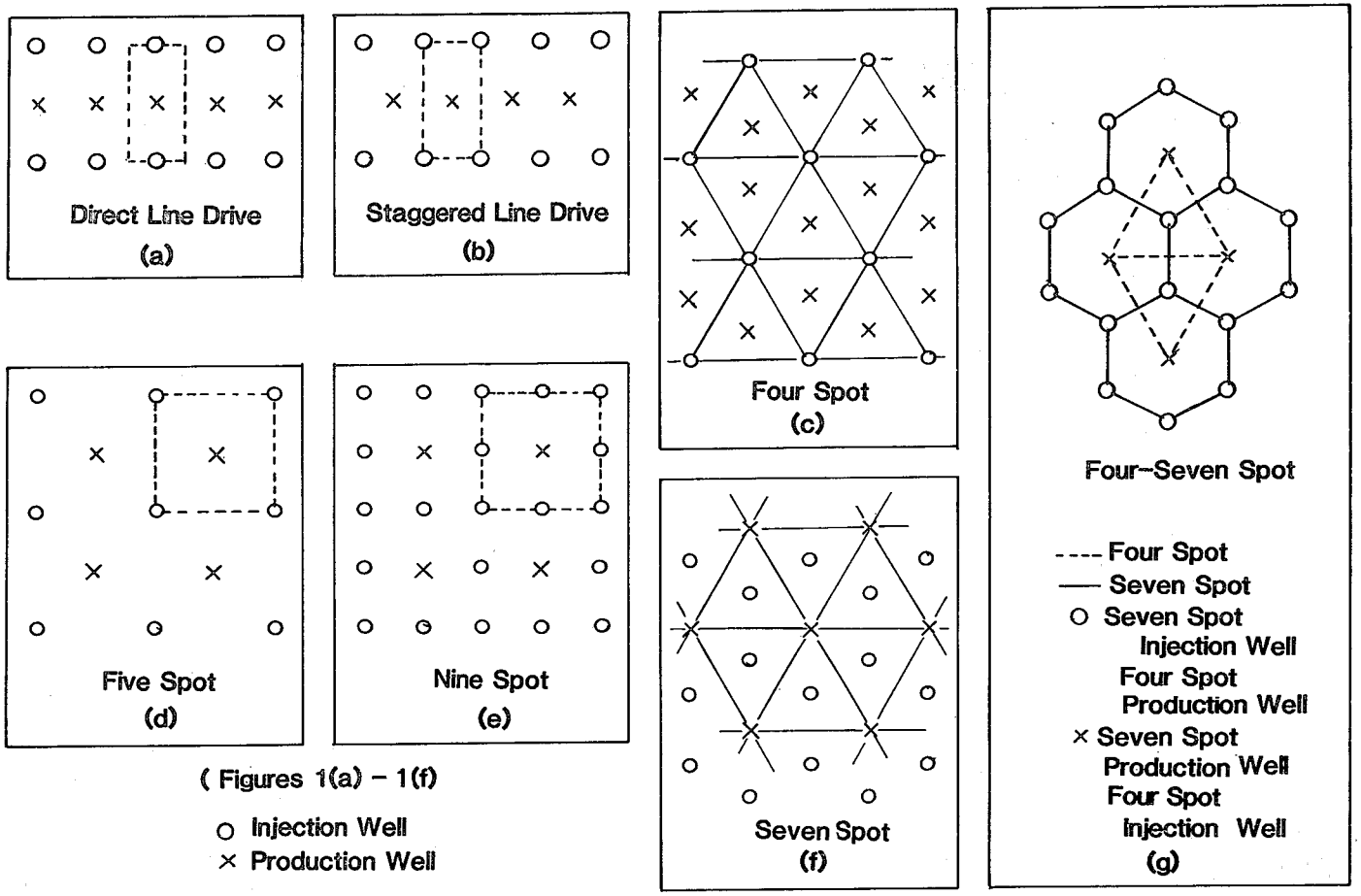
FIG. 1 illustrates several options for in situ mining well patterns.

Details of the configuration of the solution mining well field are determined in accordance with conventional considerations such as those discussed in the literature pertaining to in situ solution mining including the reference cited above, all of which are incorporated by reference herein. In preferred configurations, separate wells are employed for injection of the leach solution and for production of the pregnant solution. It is also possible to use a push/pull configuration wherein the same well is used for both injection and production. Several well configurations which might be used are shown in FIG. 1.

After production from the well field, the pregnant solution is subjected to treatment for removal of boric acid. Of course, any conventional crystallization/-precipitation or other separation technique can be employed; however, it is especially preferred in accordance with this invention that, when possible, the boric acid be separated from the mother liquor by crystallization in an evaporation pond. In its simplest form, this stage of the process simply involves the absorption of solar energy to remove sufficient water from the pregnant solution to effect nucleation and crystallization of boric acid. This selective crystallization of boric acid in the presence of calcium chloride is possible because of the much lower solubility of $H_3BO_3$ (about 7% in water at 20° C.) compared with $CaCl_2$ (about 74% in water at 20° C.). In addition, the solubility of boric acid is depressed by increasing concentrations of calcium chloride by the well known salting out effect.

Since the pregnant solution, in general, will contain amounts of boric acid close to the solubility limit, the requisite precipitation will be relatively easy to effect.

The precise extent of evaporation, i.e., recovery of boric acid from the pregnant solution, is not critical but will be chosen based on the usual considerations; for example, while the process is continuing, evaporation will not proceed to dryness or even close thereto since it is required that the remaining concentrated (saturated) solution be sent to the next stage for crystallization of gypsum and concomitant regeneration of hydrochloric acid.

Accordingly, the amount of boric acid which is recovered at the evaporation pond stage for a given charge of pregnant solution will be in the range of 50–80%. The range depends on the relative concentrations of $H_3BO_3$ and $CaCl_2$ in solution. In general, it is preferred that the balance be weighted somewhat in favor of increased boric acid production as long as the additional water makeup which will be necessary during the gypsum crystallization/regeneration stage is tolerable. Whenever it is necessary or desirable to shut down the mining operation for any reason, the residual amount of boric acid in the evaporations ponds can be conventionally recovered by evaporation and harvesting.

In general, the temperature of the evaporation pond will depend upon atmospheric conditions but usually is in the range of 10° C.–40° C., commonly around 30° C.

Irrespective of the separation method, whenever makeup water is required, it will commonly be preferred to add the water in the gypsum crystallization/regeneration stage. This is very easily accomplished by including part of the requisite amount of water in the sulfuric acid which is added to regenerate the hydrochloric acid and precipitate the gypsum. Generally, when an evaporation pond is utilized, the additional water requirements needed will be equivalent to the amount of water evaporated from the pond.

The amount of $H_2SO_4$ which is added, in essence, is the stoichiometric amount required to regenerate all of the HC1 from the calcium chloride. A slight excess of sulfuric acid may be employed. This is shown in the flow diagrams of FIGS. 2 and 3 by the recycled amount of sulfuric acid. The excess is usually only about 0.1%.

The gypsum crystallization, hydrochloric acid regeneration, thickener and filtration stages are all per se conventional. Details of these operations are chosen, perhaps with a few routine preliminary experiments, employing the usual conventional considerations.

In the gypsum crystallization/HCl regeneration stage, the method of addition, residence time, and other relevant parameters of the operation are conventionally chosen, to produce, preferably, crystalline gypsum, which settles and filters readily. For example, this may be achieved by contacting the calcium chloride solution with sulfuric acid, either concentrated or diluted to 25 to 50%, in four stirred reactors giving a total residence time of 2 to 12 hours, typically 4 hours. It is preferable to add all the acid to the first reactor and the calcium chloride solution to the first three reactors in equal amounts. This produces nuclei of gypsum crystals in the first reactor which subsequently grow to relatively large easily filterable crystals, in the remaining three reactors.

Figure 2:
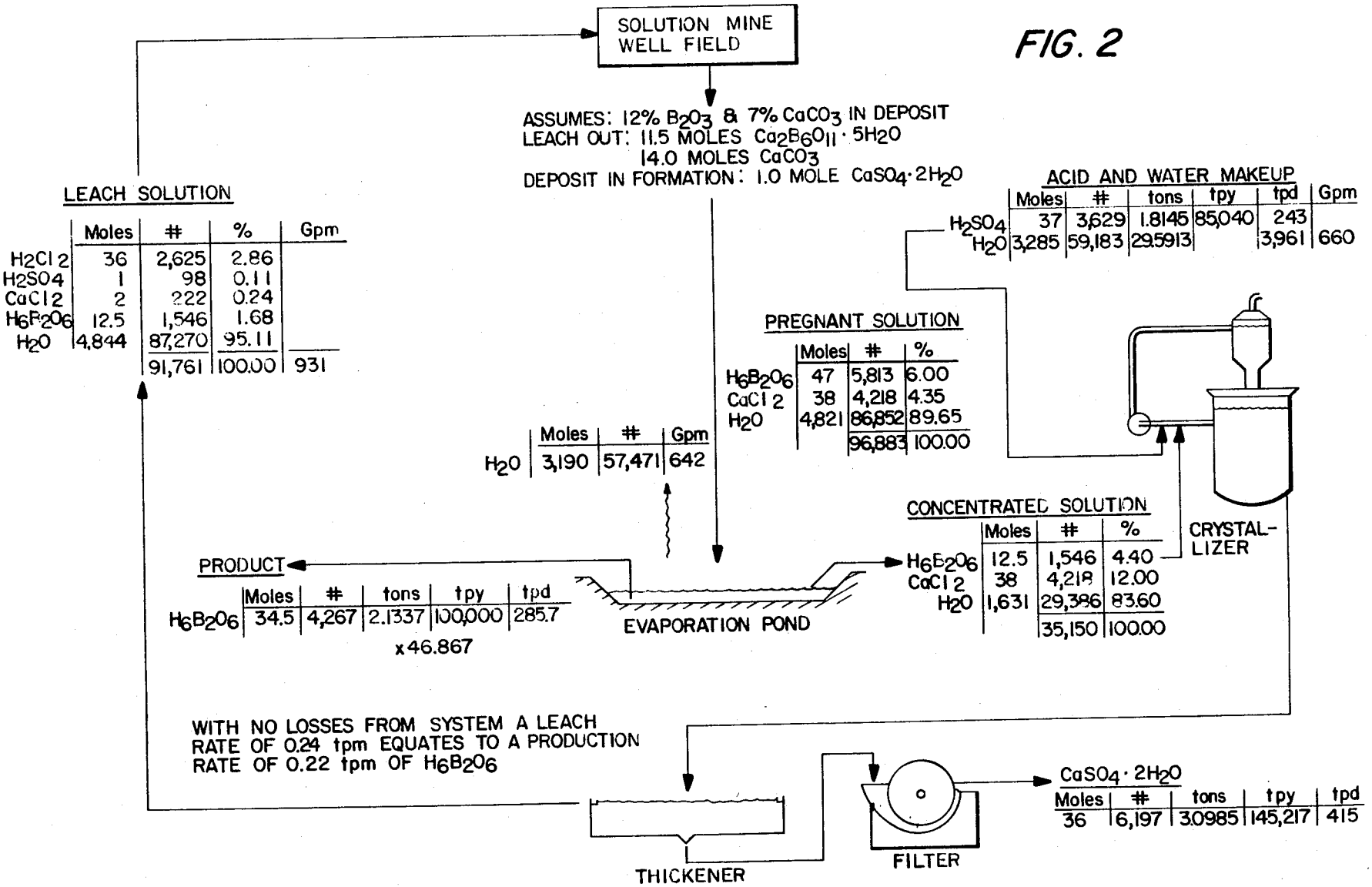
FIG. 2 depicts one variant of the process of this invention with compositional details.

FIG. 2 summarizes one particular set of operating parameters and process results for the basic process. The particular system design is based upon a recovery of 6% boric acid solution from the mine. Of course, when the system parameters permit recovery of a higher percentage of boric acid solution, this will be advantageous, e.g., the amount of water utilized will be reduced. Similarly, other parameters shown in the figure can be varied within relatively wide limits; precise values in each case will be chosen by conventional considerations including, the nature of the ore deposit, pond characteristics, gypsum demand, productivity rate, cost effectiveness, etc. While the basic process comprises the steps of ore leaching, boric acid separation, HCl regeneration and gypsum formation and separation, and HCl recycling, there are numerous options which can be used to optimize the process for given deposit characteristics, for the particular time of year involved, for prevailing climatic conditions, for commercial demands on byproduct gypsum, and for many other system parameters which will be readily recognized by one skilled in the art. Precisely which of the various optional configurations discussed below will be advantageous for use in any given system will depend on the unique requirements attendant thereto. However, for any ore deposit, the basic process of this invention will be effective in providing the basic advantages discussed above.

Figure 3:
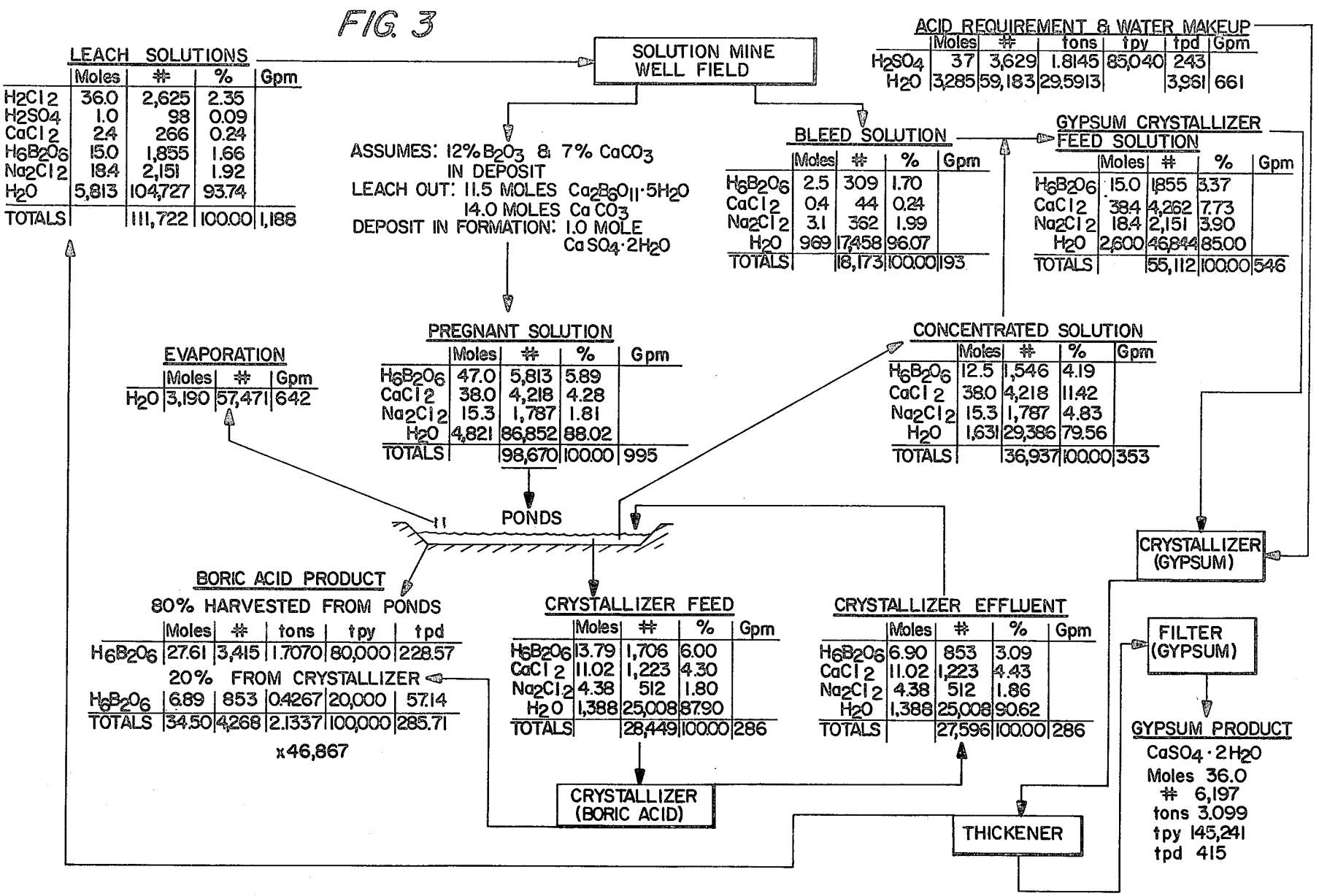
FIG. 3 shows another variant of the process of this invention with compositional details and including bleed solution and pond solution recycles.

FIG. 3 depicts a variant of the process of this invention which employs some additional optional features. The detailed stoichiometry of this figure is also based upon a recovery of approximately 6% boric acid solution. One optional feature involves the introduction of a bleed solution stream taken from the weaker or outer perimeter wells, e.g., having pregnant solutions of 0.5–3.0 wt. % boric acid. This solution is recirculated through the system but bypasses the evaporation pond(s). Because of the significantly lower boric acid concentration of the bleed solution, it provides an excess amount of water to the system, thereby significantly reducing the amount of makeup water which must be replenished after evaporation. This represents a convenient means of increasing the benefical effects on the overall process derived from the usually unavoidable but otherwise less efficient wells. Generally, the amount of bleed solution will be 10–20% based on the amount of pregnant solution. FIG. 3 also schematically illustrates a recirculation option which can be used in conjunction with the evaporation pond, especially during the summer months. In this option, an approximately 6% (i.e., essentially saturated) boric acid solution taken from the ponds at about 40°–45° C. is fed through a conventional crystallizer which produces additional boric acid by precipitation at a lower temperature, e.g., 30° C. The effluent is then recycled back into the evaporation pond. This effluent generally contains a much lower concentration of boric acid, e.g., generally 2–4 wt. %. The amount of solution recirculated in this manner is usually 20–40% of the amount of pregnant solution added to the pond. The primary benefit of this additional recirculation feature will be derived during summer months when the temperature of the evaporation pond is highest. Then, the solubility change of boric acid due to the temperature change will be greatest.

Figure 4:
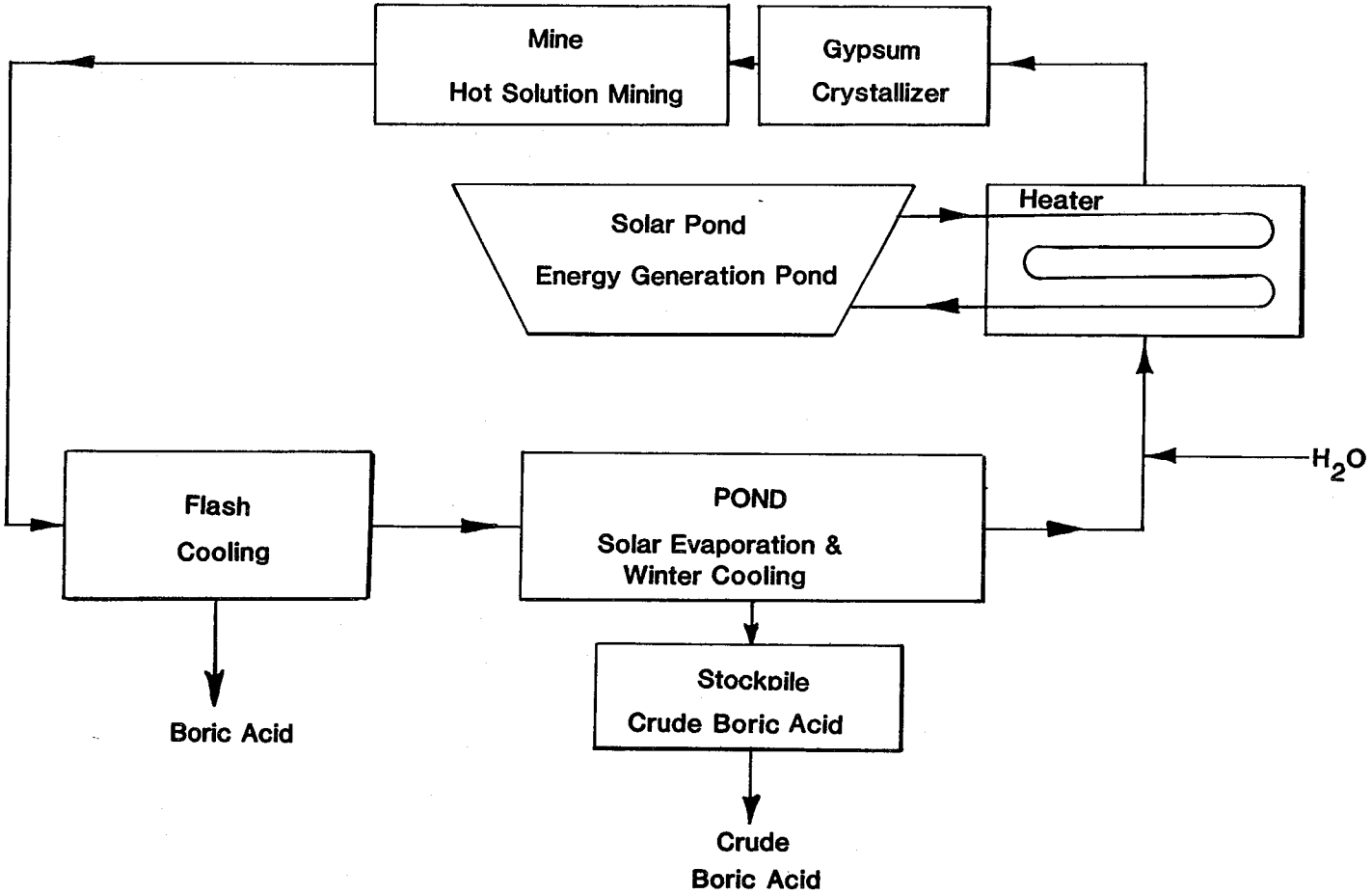
FIG. 4 schematically illustrates a variant of the process of this invention wherein the leaching solution is heated and flash cooling is employed.
Figure 5:
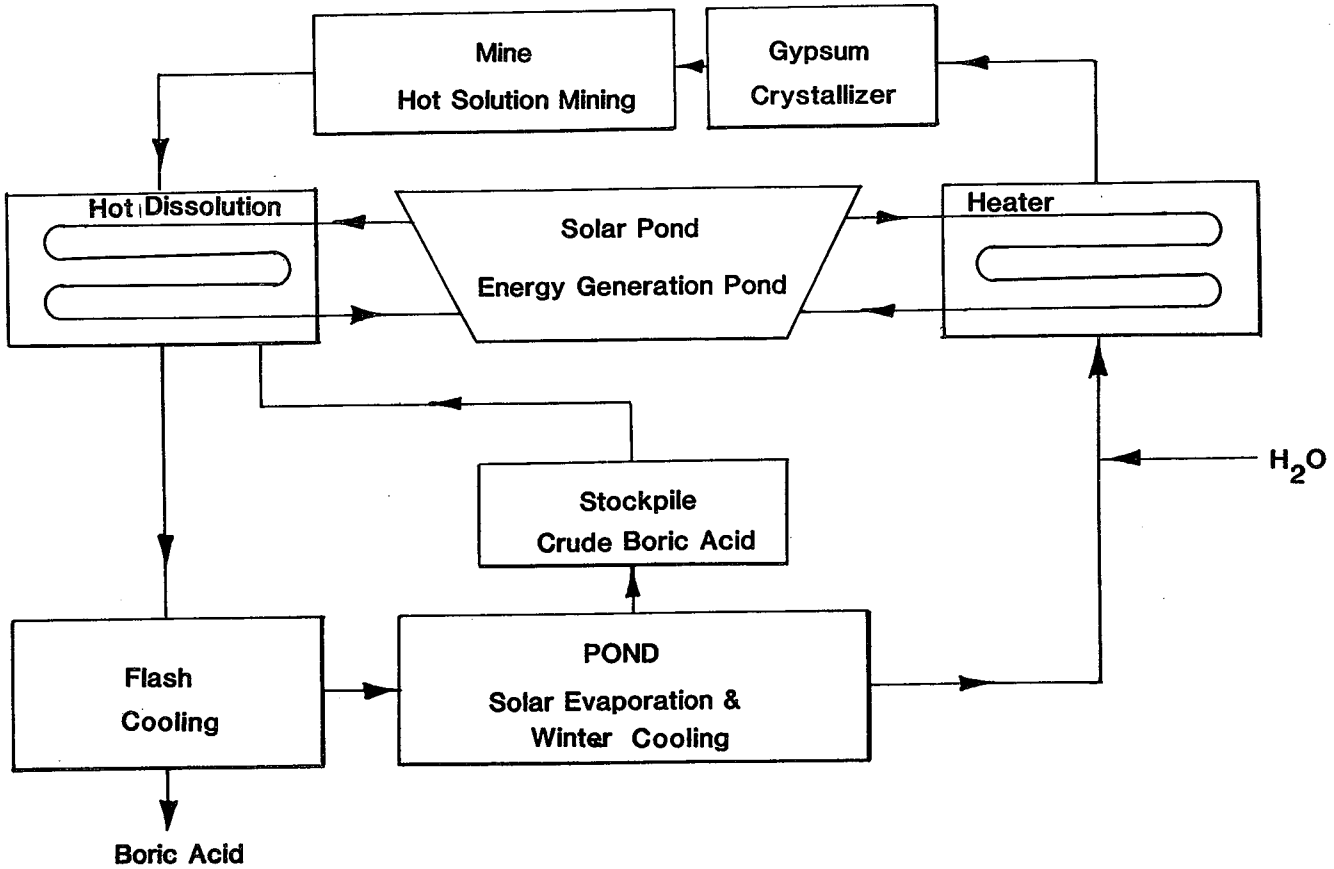
FIG. 5 schematically illustrates another variant as in FIG. 4 but where, additionally, the pregnant solution is heated and crude boric acid is recycled thereto and recrystallized therefrom.
Figure 6:
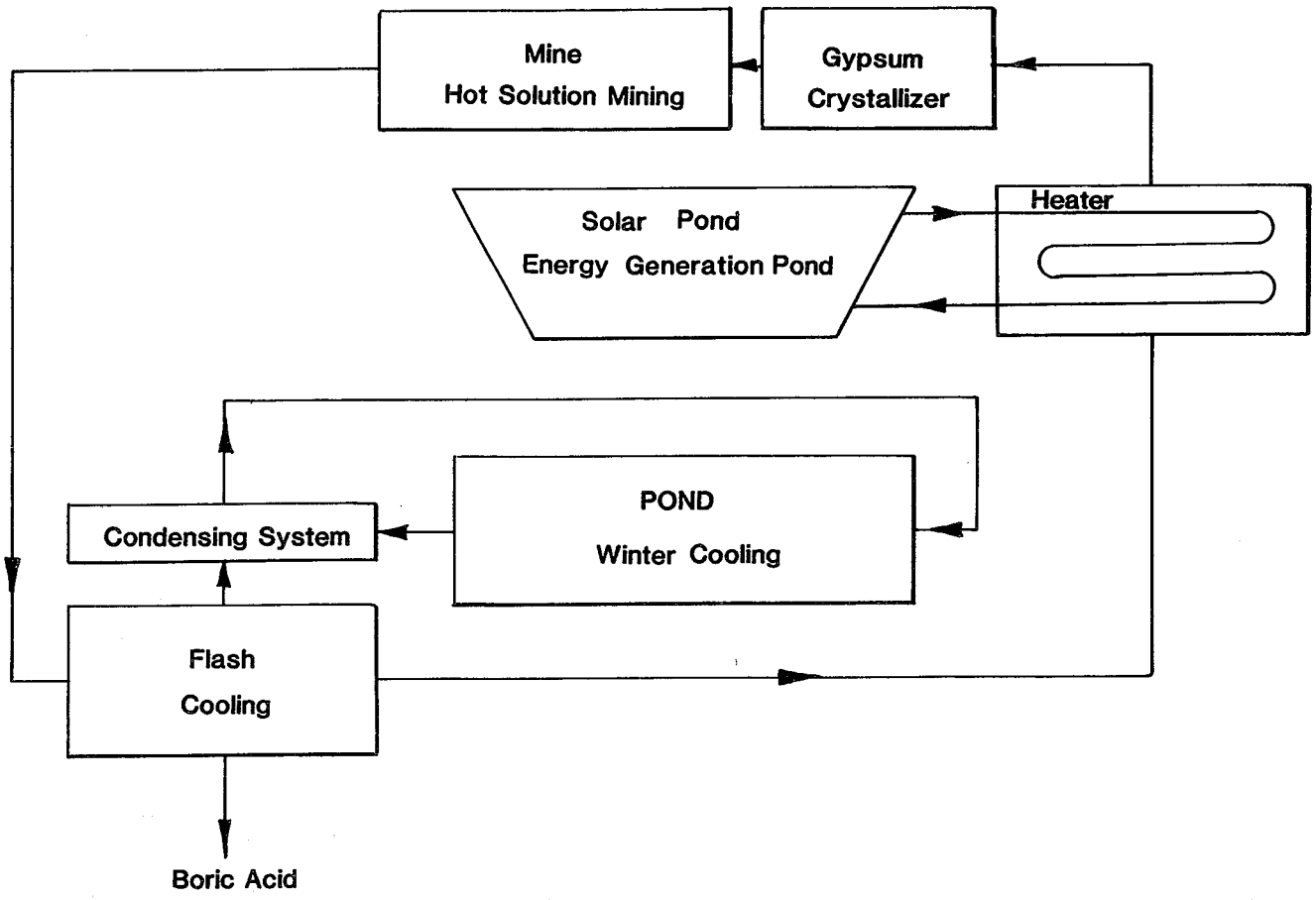
FIG. 6 schematically illustrates yet another variant of the process of this invention wherein leaching solution is heated and flash cooling is employed in conjunction with a condensing system utilizing cold water from the winter pond.
Figure 7:
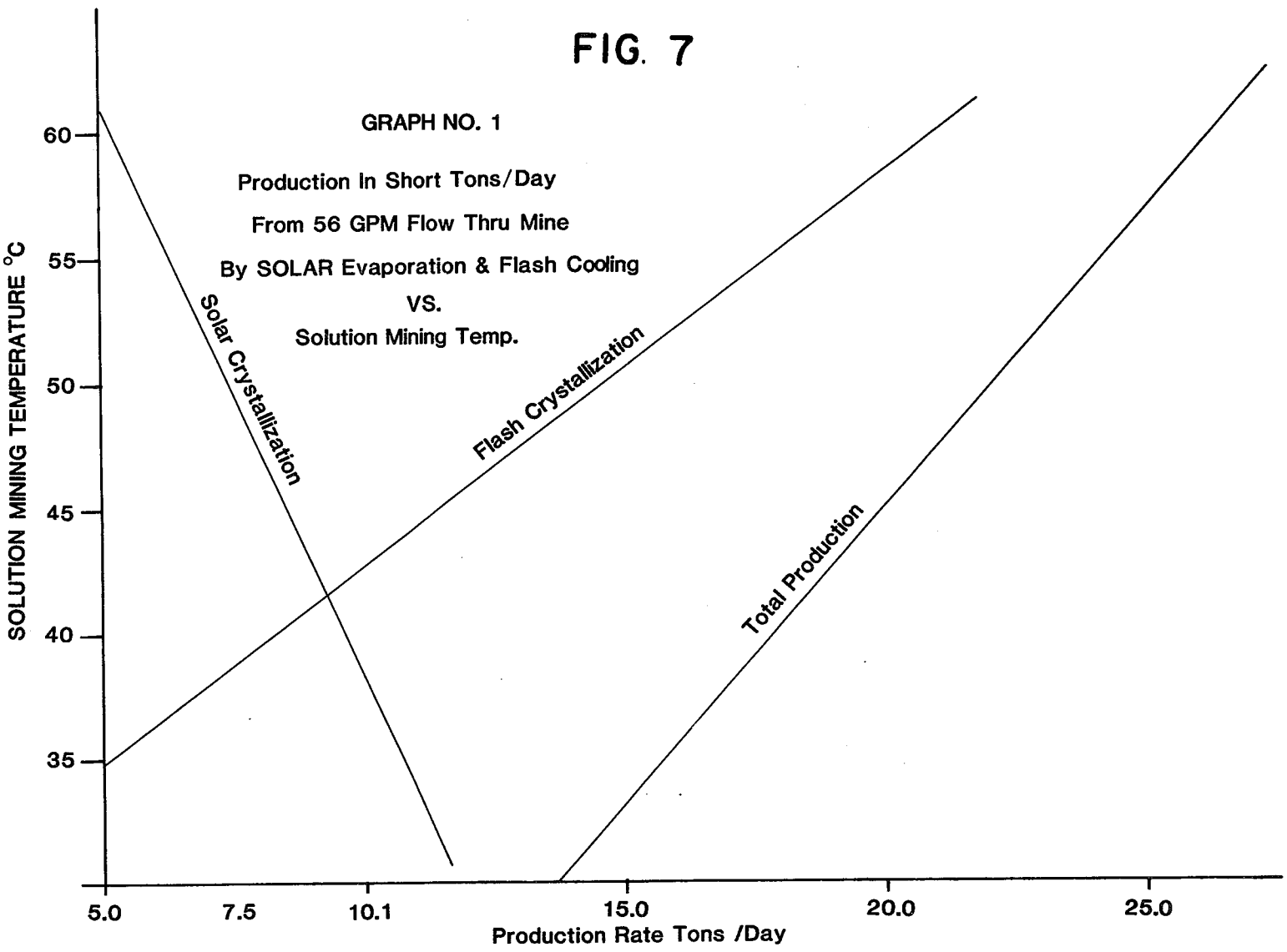
FIG. 7 shows the relationship between solution mining temperature and the total production rate achieved by the process of this invention using both solar crystallization and flash crystallization, as well as the production rates achieved by each component.

FIGS. 4–6 depict other preferred optional variants of the method of this invention. The primary feature of all of these variants is the use of a heated leaching solution for injection into the mine field. It has been discovered that by heating the leaching solution, a drastic reduction in the area of the evaporation pond without any negative effect on the production rate is obtained if flash crystallization is employed. This advantage can be readily appreciated by inspection of Table 1. At the higher temperatures, there is a significant increase in production due to flash crystallization alone or due to solar crystallization alone. However, the former increase is much more dramatic than the latter. Thus, at the higher temperatures, a relatively larger portion of boric acid can be crystallized by the flash step, reducing the production demand on the solar function. The higher temperatures thus primarily reduce the amount of water otherwise required if solar crystallization alone is utilized. This overall effect is illustrated in FIG. 7.

As further shown in FIG. 4, the flash cooling step can be employed as a pre-precipitation of boric acid prior to entrance of the pregnant solution into an evaporation pond. A further advantage of the flash cooling step is that the boric acid precipitated therein will be of higher quality than the crude boric acid which is obtained from the evaporation pond per se.

FIG. 5 illustrates other optional features. For example, the pregnant solution itself is further heated using any of the techniques mentioned above. Final temperatures usually are 50°–70° C. This provides additional capacity for dissolution of boric acid, e.g., of crude boric acid stockpiled from the evaporation pond. Normally, sufficient crude boric acid is added to saturate the pregnant solution at its elevated temperature. Because the boric acid which precipitates out of the flash cooling step is of higher purity than that derived from the evaporation pond, this recycling of the crude boric acid into the heated pregnant solution in essence represents a recrystallization step.

TABLE 1

DAILY PRODUCTION & EVAPORATION REQUIREMENT FROM 56 GPM FLOW THRU MINE VS. SOLUTION MINING TEMPERATURE

| SOLUTION MINING TEMPERATURE °C. | PRODUCTION RATE IN SHORT TONS PER DAY FROM 56 GPM FLOW THRU MINE | | | | | EVAPORATION RATE SHORT TONS/DAY SOLAR EVAPORATION REQUIREMENT | | EVAPORATION TON PER TON PR. SOLAR EVAPORATION TON $H_2O$ PER TON PRODUCT | |
|---|---|---|---|---|---|---|---|---|---|
| | SOLAR EVAP. ONLY | FLASH COOLING ONLY | SOLAR EVAPORATION & FLASH COOLING | | | SOLAR EVAP. ONLY | SOLAR EVAP. & FLASH COOLING | SOLAR EVAP. ONLY | SOLAR EVAP. & FLASH COOLING |
| | | | SOLAR EVAP. | FLASH COOLING | TOTAL | | | | |
| 35 | 15.87 | 5.40 | 10.67 | 5.20 | 15.87 | 201.26 | 191.51 | 12.68 | 12.07 |
| 42 | 18.72 | 10.37 | 9.06 | 9.62 | 18.72 | 177.06 | 162.24 | 9.46 | 8.67 |
| 50 | 22.09 | 16.05 | 7.30 | 14.79 | 22.09 | 148.13 | 129.35 | 6.71 | 5.86 |
| 60 | 26.35 | 23.11 | 5.14 | 21.21 | 26.35 | 111.61 | 86.22 | 4.24 | 3.27 |

In an especially preferred version of the process of this invention, the leaching solution is heated to a temperature of 50°–70° C., most preferably in heat exchange with the solar pond as shown in the figures. This can be effected readily using conventional heat exchange systems.

During the summer months, the heating of the leaching solution (as well as the heating of other solutions mentioned below) can be achieved by conventional heat exchange based on the heat stored in the solar pond. Alternatively, any other available source of heat can be used. Particularly during the winter months, a conventional solar pond which efficiently stores heat but does not produce significant evaporation can be utilized. Similarly, where there is an available source of waste heat, e.g., steam or other effluents of elevated temperature, this can be used as a primary or secondary source of heat. Under some circumstances, it might also be desirable to utilize heat which is produced in the process itself for these purposes. For example, when sulfuric acid is added to the concentrated solution for regeneration of hydrochloric acid, heat is produced. Where cost effective, this otherwise wasted energy can be transferred to the leach solution.

As noted, the significant reduction in evaporation pond requirements is derived primarily from the fact that, due to the higher temperature, the pregnant solution has a higher carrying capacity for boric acid, so that more efficient use can be made of a conventional flash cooling step. Therein, the temperature of the solution is rapidly lowered, preferably under vacuum, to cause precipitation of crystalline boric acid. Of course, this feature is especially useful during the winter months, when the temperature differential will be greatest and evaporation ponds will be much less efficient. Usually, pregant solution temperatures will be 20°–70° C., depending on whether leaching solution and/or pregant solution heating is employed; temperatures in the cooling step will generally be 10°–30° C., preferably ambient.

In the process version of FIG. 6 another system particularly suitable for winter operation is shown. Here, the heating of the pregnant solution per se is omitted, although it can be used where desired. A winter cooling pond is employed instead of an evaporation pond and all boric acid production is from the flash cooling step. Part (e.g., 75–90%) of the solution remaining after the flash cooling step carried out in accordance with the foregoing, is passed through a condensing system. This system further cools the solution, thereby precipitating additional boric acid.

Using the process of this invention, the production of boric acid, especially from colemanite ore, is made significantly cheaper and simpler than heretofore possible using commercial methods. By arranging injection and recovery wells in a preset pattern, conventionally determined in accordance with the structure of the particular ore body and other conventional considerations such as permeability, water table, etc., in situ solution mining provides many advantages. Furthermore, the disadvantage usually attendant to solution mining techniques, i.e., potential site blockage, is readily avoided, even where calcite is present, because hydrochloric acid is used as the leaching solution.

For example, its reaction with colemanite ore is:

$$Ca_2B_6O_{11}.5H_2O + 4HCl + 2H_2O \rightarrow 6H_3BO_3 + 2CaCl_2$$

When calcite is present, the reaction with hydrochloric acid is:

$$CaCO_3+2HCl \rightarrow CaCl_2+H_2O+CO_2$$

All products are soluble.

At the same time, it is not necessary to irretrievably consume the hydrochloric acid. This invention provides for its efficient regeneration by addition of the much cheaper sulfuric acid in accordance with the following equation:

$$CaCl_2+H_2SO_4+2H_2O \rightarrow 2HCl+CaSO_4.2H_2O.$$

Only sulfuric acid is spent. Since it is approximately only $\frac{1}{8}$ as expensive as hydrochloric acid on an acid equivalent basis, this is an important advantage. The insoluble gypsum is obtained only above ground where it is fully accessible for sale as a byproduct. Concomitantly, this avoids formation of sulfuric acid-derived insoluble products in the deposit where they might cause blockage. On the other hand, sulfuric acid can be injected to selected areas when desired to redirect fluid flow by lowering permeability in selected depleted zones.

The process is also advantageous since any of the various optional features can be combined in many ways to maximize the efficiency and production of the process in correspondence with the particular conditions in existence at a given ore site. Furthermore, since most of the heating requirements for the process are efficiently and cheaply derived from solar or evaporation ponds, the process is especially economical.

By the continual removal of calcium associated with colemanite and calcite as calcium chloride, the permeability of the ore deposit is ensured. Moreover, in all of the process variants discussed herein, wherever subsidence is found to be a potential problem, it can be very easily cured by depositing gypsum into the deposit. For example, a portion of the concentrated solution emanating from the solar evaporation pond can simply be made to bypass the gypsum crystallizer and be injected into the deposit. The amount of solution is readily determined by the amount of gypsum needed in the mine to provide support. Thereafter, injection of sulfuric acid into the mine causes the formation of gypsum in the ore zone. Alternatively, sulfuric acid could be injected directly into the ore zone, i.e., without concentrated solution addition, to produce gypsum in place and boric acid.

As can be seen, using the process of this invention, the conventional necessity to move large tonnages of ore and waste rock is avoided, as are the otherwise necessary operation of crushing and grading. The cost is low, inter alia, due to the use of solar energy, the low capital expenditures for plant and equipment and the low operational costs because of the regeneration of hydrochloric acid by the much cheaper sulfuric acid.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method of recovering boric acid from a subterranean deposit of colemanite ore by solution mining, comprising:
   - supplying a leach solution comprising hydrochloric acid to the subterranean deposit via an injection well in communication therewith, whereby colemanite ore is dissolved and an aqueous pregnant solution of boric acid and calcium chloride is formed in the deposit;
   - withdrawing the pregnant solution of boric acid and calcium chloride from said deposit via a production well in communication therewith;
   - separating boric acid from the withdrawn solution;
   - adding sulfuric acid to the resultant concentrated solution from which boric acid has been separated, whereby hydrochloric acid is regenerated therein and $CaSO_4.2H_2O$ is formed;
   - separating $CaSO_4.2H_2O$ from the resultant solution containing regenerated hydrochloric acid thereby forming a regenerated leach solution; and
   - recycling the regenerated leach solution to the subterranean deposit of colemanite via an injection well.

2. A process of claim 1, wherein boric acid is precipitated from the pregnant solution of boric acid and calcium chloride by evaporation of water to crystallize boric acid.

3. A process of claim 2 wherein the evaporation is effected by solar evaporation from a pond into which the pregnant solution has been fed.

4. A process of claim 1 wherein the boric acid is precipitated from the pregnant solution by flash crystallization.

5. A process of claim 1 wherein the boric acid is precipitated from the pregnant solution by both flash crystallization and solar evaporation from a pond into which the pregnant solution has been fed.

6. A process of claim 3, 4 or 5 wherein the pregnant solution is substantially saturated in boric acid.

7. A process of claim 1 wherein the separation of $CaSO_4.2H_2O$ from the regenerated HCl comprises passing the products of the sulfuric acid addition step through a thickener and filter.

8. A process of claim 3 or 5 further comprising adding makeup water to the concentrated solution from which boric acid has been separated.

9. A process of claim 8 wherein the makeup water is provided from a separate pregnant solution taken from a second production well in communication with the deposit, which well provides a pregnant solution relatively weak in boric acid.

10. A process of claim 3, 4 or 5 further comprising heating the regenerated leach solution before it is added to the deposit.

11. A process of claim 10 wherein said heating is effected by heat exchange with a solar pond.

12. A process of claim 5 further comprising heating the regenerated leach solution before it is added to the deposit, and wherein said heating is effected by heat exchange with a solar pond and wherein the pregnant solution is flash cooled before the evaporative separation of boric acid.

13. A process of claim 1 further comprising heating the pregnant solution emanating from the deposit.

14. A process of claim 10 further comprising heating the pregnant solution emanating from the deposit.

15. A process of claim 14 wherein the leach solution and the pregnant solution are each heated by heat exchange with a solar pond.

16. A process of claim 5 further comprising heating the regenerated leach solution before it is added to the deposit and heating the pregnant solution emanating from the deposit, and wherein the boric acid separated from the evaporation pond is recycled to the heated pregnant solution to form a pregnant solution essentially saturated in boric acid.

17. A process of claim 1 wherein all injection wells are separated from the production wells.

18. A process of claim 1 wherein all wells can be used as either production or injection wells.

19. A process of claim 6 further comprising heating the regenerated leach solution before it is added to the deposit.

20. A process of claim 19, wherein said heating is effected by heat exchange with a solar pond.

21. A process of claim 6, wherein the pregnant solution is flash cooled before the evaporative separation of boric acid.

22. A process of claim 5 further comprising heating the regenerated leach solution before it is added to the deposit and heating the pregnant solution emanating from the deposit, and wherein boric acid separated form the evaporation pond is recycled to the heated pregnant solution to form a pregnant solution essentially saturated in boric acid, and wherein the pregnant solution is substantially saturated in boric acid.

* * * * *